United States Patent [19]

Gurubatham

[11] Patent Number: 4,503,582

[45] Date of Patent: Mar. 12, 1985

[54] DOUBLE-ACTING REFRIGERATOR DOOR HINGE AND SLIDING LOCK-BOLT

[75] Inventor: Vincent P. Gurubatham, Berrien County, Mich.

[73] Assignee: Whirlpool Corporation, Benton Harbor, Mich.

[21] Appl. No.: 427,111

[22] Filed: Sep. 29, 1982

[51] Int. Cl.[3] ..... E05D 15/50

[52] U.S. Cl. ..... 16/232; 16/366; 16/380; 16/DIG. 23; 49/193; 49/382; 292/335

[58] Field of Search ..... 16/230, 231, 232, 233, 16/257, 258, 259, 260, 263, 267, 268, 269, 270, 321, 323, 324, 325, 326, 327, 333, 335, 343, 345, 346, 347, 348, 349, 352, 357, 360, 366, 380, DIG. 23, DIG. 32; 312/138 R, 138 A, 214, 215, 222; 49/382, 193; 292/335, 40, 33

[56] References Cited

U.S. PATENT DOCUMENTS

| | | | |
|---|---|---|---|
| 321,266 | 6/1885 | Whitney | 49/193 |
| 418,255 | 12/1889 | Welter | 49/193 |
| 1,771,041 | 7/1930 | Huebner | 16/230 |
| 2,711,803 | 6/1955 | Hurst | 16/231 |
| 2,886,375 | 5/1959 | Crawford | 16/231 |
| 3,020,084 | 2/1962 | Sylvester | 16/224 |
| 3,290,719 | 12/1966 | Courson | 16/231 |
| 3,685,093 | 8/1972 | Sanders et al. | 49/193 X |
| 3,889,419 | 6/1975 | Maleck | 16/232 |
| 4,222,149 | 9/1980 | Holbek | 16/232 |

FOREIGN PATENT DOCUMENTS 100160 10/1964 Denmark .

*Primary Examiner*—Fred A. Silverberg
*Attorney, Agent, or Firm*—Wood, Dalton, Phillips, Mason & Rowe

[57] ABSTRACT

Hinge structure for mounting a door to a cabinet for selective opening of the door from either side of the cabinet. The hinge structure includes a slide bar which is selectively positionable as a result of the opening of the door from either side of the cabinet to a thrown position. The structure includes locking elements for retaining the slide bar in the thrown position as long as the door remains pivoted open, thereby preventing the pivoting hinge structure from being removed from the cabinet. A second safety lock is provided for effectively positively preventing withdrawal of the pivoting hinge pin from the pivot slot while the door remains open from the opposite side of the cabinet. In one form, the structure for retaining the slide bar in the thrown position includes a pivotal member, and in another embodiment, the retaining structure is defined by a closely coiled spring.

13 Claims, 8 Drawing Figures

FIG. 1
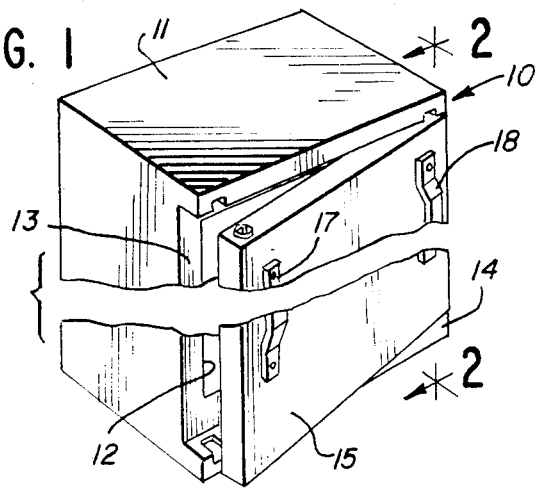
FIG. 2
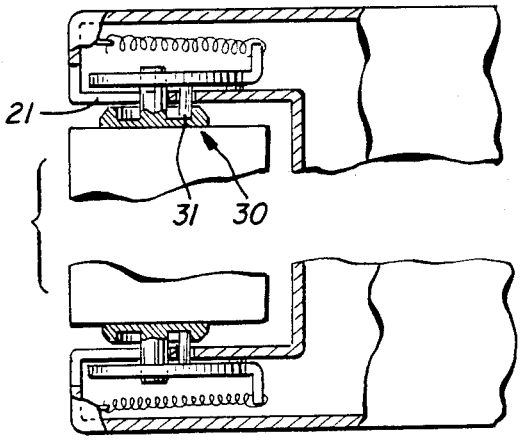
FIG. 3
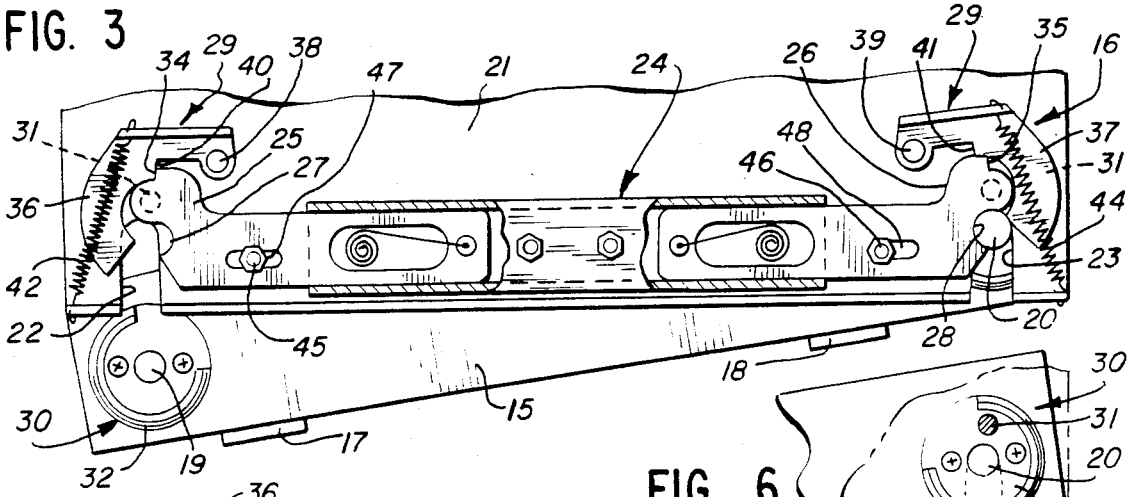
FIG. 6
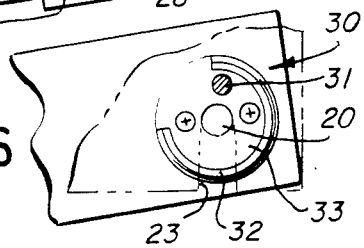
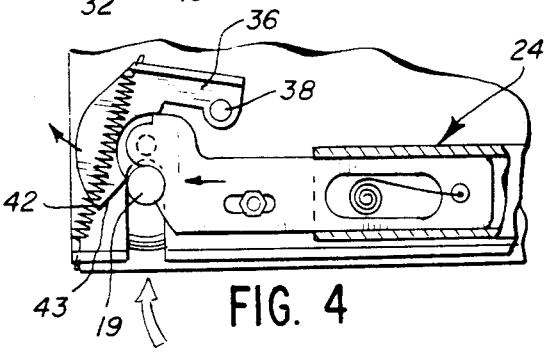
FIG. 4
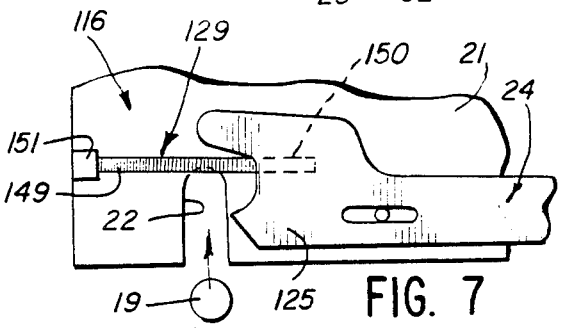
FIG. 7
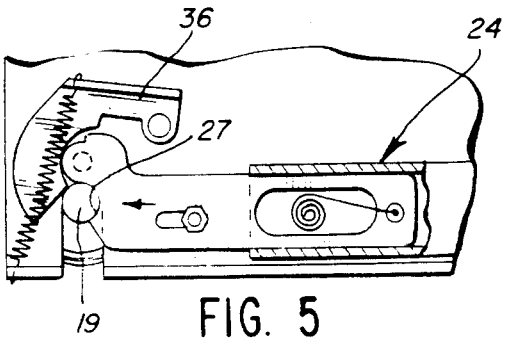
FIG. 5
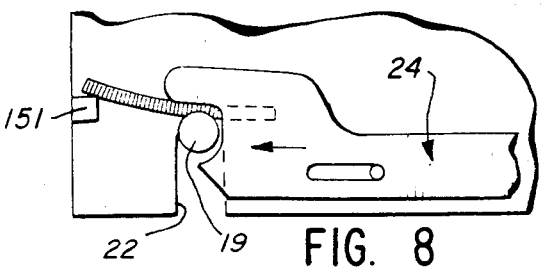
FIG. 8

DOUBLE-ACTING REFRIGERATOR DOOR HINGE AND SLIDING LOCK-BOLT

BACKGROUND OF THE INVENTION

1. Field of the Invention

This invention relates to housing structures and in particular to hinge means for mounting a door to a cabinet for selectively closing an access opening thereof from either side of the opening.

2. Description of the Prior Art

In refrigerators and the like, it is desirable to provide the access doors thereof to open from either the left or right-hand side of the cabinet. One example of such a refrigerator enclosure structure is illustrated in U.S. Pat. No. 3,889,419 of Leroy Maleck. As shown therein, the cabinet is provided with a hinge pin disposed in each corner of the access opening and the door is provided with a pair of bolt assemblies, each having a bolt member which is slidable into entrapping engagement with the hinge pin for the purpose of forming a hinge mounting adjacent either the left or right side of the door. The door includes a pair of handles on the right and left sides thereof. Each handle engages the bolt assemblies and can be moved to shift the bolts to form the hinge assembly on the side opposite to the handle that is being actuated.

In U.S. Pat. No. 321,266, John R. Whitney shows a railroad car window which can be opened from either of its opposite sides. The door mounting mechanism includes meas defining a slot and a pivot pin carried by the door frame.

In U.S. Pat. No. 2,711,803, Norman F. Hurst discloses a folding lifting boom wherein a sliding locking bar and a pair of spring latch members are provided for permitting the boom to be pivoted about either of two spaced pivot points.

Gert A. E. Holbek discloses a door hinge arrangement in U.S. Pat. No. 4,222,149 wherein a sliding latch member is cammed laterally as an incident of opening movement of the door. The latch member is carried by the door and acts as a bolt to lock one of the hinge pins in place whenever the door has been opened from the opposite side. In one embodiment, a pair of centering springs restores the bolt to its centering position when the door is closed. In another embodiment, a pair of cams shifts the latch member laterally in response to opening movement of the door. The latch member slides along a connecting rod which is restrained from lateral movement. Relative motion between the connecting rod and latch member locks the hinge pin at the side of the door opposite that which is being opened.

SUMMARY OF THE INVENTION

The present invention comprehends an improved hinge means for mounting a closure door to a cabinet for permitting the door to be opened from either side of the access opening selectively closed thereby.

It is an object of the present invention to provide a hinge means which permits a door to be opened easily from either side and which includes improved means for preventing the door from being accidentally disengaged from the cabinet on both sides, thus providing a door hinge means which is particularly suited for use on refrigerators or the like where accidental complete disengagement of the door is highly undesirable.

The hinge means of the present invention comprehends the use of a sliding lock bolt for providing the improved selective hinging of the door.

In the illustrated embodiment, the lock bolt comprises a slide bar having a preselected length and configuration for effectively preventing movement of both hinge pins provided on the door at opposite sides of the opening beyond the ends of the slide bar concurrently.

The slide bar defines catches for releasably retaining the pivot pins against movement outwardly from the recesses defined by the cabinet. The catches extend approximately halfway across the recesses so that it is necessary for the slide bar to be moved approximately one-half the width of the recess toward the opposite hinge structure to release the hinge pin.

The shifting of the slide bar is effected automatically by the outward movement of the hinge pin carried on the edge of the door being moved outwardly from the cabinet. Like mechanisms are provided at each side of the door so that the door may be opened from either side of the access opening.

The invention comprehends the provision of first lock means for effectively locking the slide bar in the thrown position for preventing withdrawal of the other pivot pin from its associated recess.

The invention further comprehends the provision of second lock means on the closure door and slide bar for positively preventing withdrawal movement of the other pivot pin while the slide bar is in a thrown position.

More specifically, the improved hinge means of the invention comprises a pair of pivot pins on the door one each at opposite sides of the door, means defining pivot recesses on the cabinet one each at the opposite sides of the opening for removably receiving the pivot pins, a slide bar movable on the cabinet and having opposite ends defining catches for releasably retaining the pivot pins against movement outwardly from the pivot recesses, means responsive to opening movement of the door from either side effecting withdrawal of the pivot pin thereat from its associated recess for effectively locking the slide bar in a thrown position preventing withdrawal of the other pivot pin from its associated recess, and cooperating safety lock means on the door and slide bar for positively preventing withdrawal movement of the other pivot pin while the slide bar is in the thrown position.

The safety lock means, in the illustrated embodiment, comprises means on the door defining a latch recess opening transversely to the pivot recess toward the adjacent end of the slide bar, and latch means on the slide bar movable into the latch recess as an incident of movement of the slide bar to the thrown position.

Further more specifically, the invention comprehends the provision of such an improved means including first cooperating lock means on the cabinet and slide bar for positively preventing movement of the slide bar from the thrown position while the door is open from either side, and second cooperating lock means on the door and slide bar for positively preventing withdrawal movement of the other pivot pin while the slide bar is in the thrown position.

In the illustrated embodiment, the first lock means comprises a pair of first lock shoulders one each on the opposite ends of the slide bar, a pair of lock elements pivotally mounted one each on the cabinet adjacent the opposite ends of the slide bar and having second lock shoulders selectively engageable with an associated one of the first lock shoulders for preventing return movement of the slide bar from either thrown position when associated ones of the first and second lock shoulders are engaged, and means for pivoting the lock elements to disengage the second lock shoulders thereof from the first lock shoulders as an incident of the door being disposed in closed position across the opening.

The improved hinge means further includes means for biasing the lock elements to a position of engagement of the second lock shoulders thereof with the associated first lock shoulders and means for pivoting the lock elements against the action of the biasing means to disengage the second lock shoulders thereof from the first lock shoulders as an incident of the door being disposed in closed position across the opening.

In an alternative embodiment, the first lock means comprises a close coiled spring having one end secured to one of the cabinet and slide bar and an opposite end removably engaged with a stop shoulder fixed to the other of the cabinet and slide bar, the spring being disposed to be transversely deflected from engagement with the stop as an incident of the hinge pins being engaged with the catches.

BRIEF DESCRIPTION OF THE DRAWINGS

Other features and advantages of the invention will be apparent from the following description taken in connection with the accompanying drawings wherein:

FIG. 1 is a fragmentary perspective view of a housing structure having a closure door hingedly mounted thereto by hinge means embodying the invention;

FIG. 2 is a fragmentary enlarged vertical section taken substantially along the line 2—2 of FIG. 1;

FIG. 3 is a fragmentary horizontal section illustrating the hinge means in greater detail;

FIG. 4 is a fragmentary horizontal section illustrating an intermediate position of the hinge means in the closing of the door;

FIG. 5 is a fragmentary horizontal section illustrating the arrangement of the hinge means in the closed disposition;

FIG. 6 is a fragmentary horizontal section illustrating in greater detail the safety lock means of the hinge structure;

FIG. 7 is a fragmentary horizontal section illustrating a modified form of the invention; and FIG. 8 is a fragmentary horizontal section illustrating the arrangement of said modified form in the closed disposition of the closure door.

DESCRIPTION OF THE PREFERRED EMBODIMENTS

In the illustrative embodiment of the invention as disclosed in FIGS. 1–6, a housing structure generally designated 10 is shown to comprise a cabinet 11 having an access opening 12 defining opposite sides 13 and 14 and a closure door 15 for selectively closing the access opening.

The invention comprehends the provision of improved hinge means generally designated 16 for mounting closure door 15 to the cabinet to permit the door to be opened from either side of the opening. The door may be provided with a suitable left handle 17 and right handle 18 for use in opening the door selectively from the left side 13 or right side 14 of the cabinet.

In the illustrated embodiment, a pair of hinge means 16 is provided, one being disposed at the top of the door and one at the bottom of the door. In describing hinge means 16, reference will be made to the top hinge means, it being understood that the bottom hinge means structure is identical, although disposed in inverted relationship thereto.

As best seen in FIGS. 2 and 3, hinge means 16 includes a pair of pivot pins 19 and 20 upstanding from the closure door at opposite sides thereof. The cabinet defines an inturned flange 21 provided with pivot recesses 22 and 23, respectively, at opposite sides of the access opening 12 for removably receiving the pivot pins 19 and 20.

A slide bar structure 24 is movably mounted on the cabinet and includes opposite ends 25 and 26 forming catches 27 and 28 for releasably retaining the pivot pins against movement outwardly from the recesses 22 and 23, respectively.

The invention comprehends the provision of improved means 29 responsive to opening movement of the door 15 from either side of the access opening effecting withdrawal of the pivot pin thereat from its associated recess to effectively lock the slide bar in a thrown position preventing withdrawal of the other pivot pin from its associated recess. Thus, illustratively, as seen in FIG. 3, when the pivot pin 19 is withdrawn from the recess 22, the slide bar structure 24 is locked in the thrown position wherein the catch 28 prevents withdrawal of pivot pin 20 from recess 23.

The invention further comprehends the provision of a second, cooperating safety lock means generally designated 30 on the door and slide bar respectively for positively preventing withdrawal movement of the pivot pin once the opposite side of the door has been moved to an open position. Thus, as seen in FIGS. 2 and 6, safety lock means 30 includes a latch pin 31 extending downwardly from each end of the slide bar structure 24 receivable within a segmented annular upstanding wall 32 on a base 33 coaxially of the pivot pin. As shown, the wall extends approximately 270° opening toward the pin 31 so that when the slide bar structure is moved to the thrown position and the opposite side of the door is moved to an open position, such as illustrated in FIG. 6, pin 31 is received within the distal end of the wall 32, further effectively preventing outward movement of the door end and pivot pin 20 carried thereon, thereby further securing the pivot pin in the pivot recess.

Thus, the safety lock means 30 on the door 15 defines a latch recess opening transversely to the pivot recess 23 toward the adjacent end of the slide bar structure 24, and latch pin 31 on the slide bar structure is movable into the recess as an incident of movement of the slide bar structure to the thrown position. As shown, the recess means is effectively defined by a C-shaped wall upstanding from the pivot pin mounting base.

As best seen in FIGS. 3, 4, and 5, the means 29 for effectively locking the slide bar in either of its thrown positions comprises a first pair of first lock shoulders 34 and 35, one each on the opposite ends 25 and 26 of the slide bar structure 24. The slide bar locking means further includes a pair of lock elements 36 and 37 pivotally mounted one each to the cabinet adjacent the opposite ends of the slide bar structure by suitable pivots 38 and 39, respectively. Lock element 36 defines a second lock shoulder 40 cooperating with lock shoulder 34 of the slide bar structure, and lock element 37 defines a lock shoulder 41 cooperating with lock shoulder 35 of the slide bar structure for preventing return movement of the slide bar from either thrown position when associated ones of the first and second lock shoulders are engaged. Thus, illustratively, as shown in FIG. 3, when the left-hand side of the door is swung outwardly to move the slide bar structure 24 to the right-hand thrown position, lock element 36 is biased in a counter-clockwise direction on pivot 38 by a coil spring 42 connected between element 36 and cabinet flange 21 so as to move shoulder 40 into engagement with shoulder 34 at the left-hand end of the slide bar structure, effectively retaining the slide bar structure in the right-hand thrown position as long as the door remains open from the left-hand side with the pivot pin 19 externally of slot 22.

However, when the left-hand portion of the door is swung back to the closed position, as illustrated in FIG. 4, pivot pin 19 engages a camming surface 43 on the lock element 36 to overcome the biasing action of spring 42 and pivot element 36 in a clockwise direction to release lock shoulder 40 from engagement with lock shoulder 34 and permit the slide bar structure 24 to move to a centered position wherein the pivot pin 19 is fully engaged with the catch 27, as illustrated in FIG. 5.

The right-hand lock means 29 includes a similar coil spring 44 for biasing lock element 37 in a clockwise direction for providing releasable engagement between shoulder 41 thereof and shoulder 35 on the right-hand end of the slide bar, as seen in FIG. 3. Thus, the slide bar lock means 29 provide effective retention of the slide bar structure 24 in thrown position whenever the door is opened from either side so as to prevent complete removal of the door from the cabinet by retaining the other pivot pin effectively in the pivot recess for hinged movement of the door thereabout.

Slide bar structure 24 is mounted to the flange 21 for substantially rectilinear reciprocal movement by means of a pair of slide bolts 45 and 46 secured to the flange 21 to extend through association elongated slots 47 and 48 in the slide bar structure.

Thus, hinge means 16 provides an improved hinge mounting of the door 15 to cabinet 11 for selective opening from either side of the access opening 12 while effectively assuring retained association with the cabinet of the portion of the door about which the door is pivoted. This improved safety retention of the door to the cabinet is effected by means of a slide bar acting as a sliding lock bolt which releasably retains the door in the closed position by cooperation of suitable catches on the slide bar with the pivot or hinge pins carried by the door. When the door is opened from either side, the slide bar is automatically thrown to a locking position wherein the catch effectively retains the pivoting hinge pin in the pivot recess, with the slide bar retained in the thrown position by the locking means 29 until such time as the door is returned to the fully closed position.

Thus, the invention comprehends the provision of first and second positive lock means 29 and 30 for preventing withdrawal of the pivoting hinge pin from the cabinet. The door may be readily opened from either side of the cabinet, while yet the door is positively maintained hingedly mounted to the cabinet by the opposite hinge means.

Referring now to FIGS. 7 and 8, a modified form of hinge means, generally designated 116, is shown to comprise a hinge structure generally similar to that of hinge means 16 except for the provision of a modified form of slide bar locking means generally designated 129 in lieu of locking means 29 of the first embodiment. Thus, as seen in FIG. 7, locking means 129 comprises a close coiled spring 149 having one end 150 fixedly secured to the end of the slide bar structure, such as end 125 at the left-hand of the slide bar structure as illustrated in FIG. 7. A similar slide bar locking means 129 (not shown) is provided at the right-hand end of the slide bar.

As shown in FIG. 7, when the slide bar is in the thrown disposition as by opening of the door from the left-hand side of the cabinet so as to withdraw pivot pin 19 from the pivot slot 22, spring 149 is permitted to extend rectilinearly from end 150 into engagement with a stop 151 carried on the flange 21. Because of the close coiled configuration of spring 149 the spring cannot be compressed, and the slide bar structure 24 is prevented from moving to the left.

When the door is brought back to the closed position so as to bring pin 19 into slot 22 and into engagement with the spring 149, the spring is deflected by the engagement of pin 19 therewith so as to move rearwardly of stop 151, permitting the slide bar structure 24 to move back to the latching disposition shown in FIG. 8 wherein the pin 19 is captured within the slot 22.

Spring 149 functions in a manner similar to the functioning of the lock means 29 of the first described embodiment in effectively maintaining the slide bar structure in the thrown position as long as the door remains pivoted to an open position from either side of the cabinet. However, upon return of the door to the closed position, the locking means 129 permits the slide bar structure to move back to the centered disposition releasably retaining each of the pivot pins in the associated pivot slots for subsequent opening of the door from either side as desired.

Thus, in the modified embodiment of the invention, the slide bar locking means comprises deflectible stop means at each end of the slide bar structure disposed to extend rigidly between the cabinet and the slide bar as an incident of the slide bar being moved to the thrown position. The deflectible stop is arranged to be transversely deflected from engagement with the stop on the cabinet as an incident of movement of the hinge pin upon reclosing of the door.

Thus, the improved door mounting means of the present invention provides extremely simple and economical construction while yet providing a plurality of safety interlocks preventing the door from becoming completely disengaged from the cabinet.

The foregoing disclosure of specific embodiments is illustrative of the broad inventive concepts comprehended by the invention.

Having described the invention, the embodiments of the invention in which an exclusive property or privilege is claimed are defined as follows:

1. For use in a housing structure having a cabinet having an access opening defining opposite sides, and a door for selectively closing said opening, said door defining opposite sides, hinge means for mounting the door to the cabinet with the opposite sides of the door juxtaposed respectively to the opposite sides of the access opening and permitting the door to be opened from either side of the opening, said hinge means comprising:

a pair of pivot pins on the door one each at the opposite sides of the door;

means defining a pair of pivot recesses on the cabinet one each at said opposite sides of the opening for removably receiving said pivot pins;

a slide bar selectively reciprocably longitudinally movable on the cabinet and having opposite ends defining catches for releasably retaining the pivot pins, said catches and slide bar being constructed to prevent concurrent movement of both pivot pins outwardly from said pivot recesses; and a pair of locking means one each at said opposite ends of the slide bar responsive to opening movement of the door from either side effecting withdrawal of the pivot pin thereat from its associated recess for effectively longitudinally moving said slide bar to and locking the slide bar in a thrown position preventing withdrawal of the other pivot pin from its associated recess, each said locking means comprising a retainer pivotally mounted to the cabinet and defining a shoulder facing toward the adjacent end of the slide bar, means on the slide bar end facng toward the retainer shoulder, biasing means for biasing the retainer to urge the retainer shoulder into the path of movement of the slide bar shoulder, first cam means on said retainer for engagement by the associated pivot pin as the pivot pin is moved into the associated pivot recess to urge the retainer pivotally to move the retainer shoulder out of the path of movement of the slide bar shoulder permitting the slide bar to move longitudinally sufficiently to cause the catch at that end to engage the pivot pin in the pivot recess to retain the door edge thereat pivotally mounted to the adjacent cabinet side, the slide bar end further defining a second cam means for engagement by the pivot pin as an incident of the side of the door being urged away from the adjacent side of the cabinet with the locking means at the opposite end of the slide bar locking the pivot pin on the opposite side of the door pivotally to the opposite side of the cabinet to urge the slide bar longitudinally toward said opposite side of the cabinet and permit the retainer to be pivoted by the biasing means to urge the retainer shoulder into the path of movement of the adjacent slide bar shoulder to prevent longitudinal movement of the slide bar away from said opposite side of the door thereby effectively positively locking the slide bar in the thrown position as long as the pivot pin withdrawn from the pivot means remains withdrawn; and cooperating safety lock means on said door and slide bar for positively preventing withdrawal movement of said other pivot pin while said slide bar is in said thrown position.

2. The hinge means of claim 1 wherein said safety lock means comprises means on said door defining a latch recess opening transversely to an adjacent pivot recess toward the adjacent end of the slide bar, and latch means on the slide bar movable into said latch recess as an incident of movement of the slide bar to said thrown position.

3. The hinge means of claim 1 wherein said safety lock means comprises means on said door defining a latch recess opening transversely to an adjacent pivot recess toward the adjacent end of the slide bar, and a latch pin on the slide bar movable into said latch recess as an incident of movement of the slide bar to said thrown position.

4. The hinge means of claim 1, wherein said safety lock means comprising means defining a latch recess on the door and a latch member associated with said slide bar to be received in said latch recess as an incident of movement of said slide bar to retain either one of the pivot pins in its associated said pivot recess.

5. The hinge means of claim 1 wherein said safety lock means comprises a C-shaped wall upstanding from said door to define a catch, and said latch member comprises a latch pin carried by the slide bar.

6. The hinge means of claim 1, wherein said safety lock means comprises means for positively preventing withdrawal movement of said other pivot pin as an incident of said slide bar being moved to said thrown position and said door to said open position.

7. The hinge means of claim 1 including means for pivoting the retainers to disengage the retainer shoulders from the slide bar shoulders as an incident of said door being disposed in the closed position across said opening.

8. The hinge means of claim 1 including cam means for pivoting the retainers to disengage the retainer shoulders from the slide bar shoulders as an incident of said door being disposed in the closed position across said opening.

9. The hinge means of claim 1 further including cooperating means on said cabinet and slide bar for constraining movement of the slide bar to a rectilinear path.

10. The hinge means of claim 1 including cam means for pivoting the retainers against the action of said biasing means to disengage the retainer shoulders from the slide bar shoulders as an incident of said door being disposed in the closed position across said opening, and cooperating means on said cabinet and slide bar for constraining movement of the slide bar to a rectilinear path.

11. For use in a housing structure having a cabinet having an access opening defining opposite edges, and a door for selectively closing said opening, hinge means for mounting the door to the cabinet permitting the door to be opened from either side of the opening, said hinge means comprising:

a pair of pivot pins on the door one each at opposite sides of the door;

means defining a pair of pivot recesses on the cabinet one each at said opposite sides of the opening for removably receiving said pivot pins;

a slide bar movable on the cabinet and having opposite ends defining catches for releasably retaining the pivot pins against movement outwardly from said pivot recesses;

means responsive to opening movement of the door from either side effecting withdrawal of the pivot pin thereat from its associated recess for effectively locking the slide bar in a thrown position preventing withdrawal of the other pivot pin from its associated recess; and cooperating safety lock means on said door and slide bar for positively preventing withdrawal movement of said other pivot pin while said slide bar is in said thrown position, said safety lock means comprising a C-shaped wall upstanding from said door defining a latch recess opening transversely to the adjacent pivot recess toward the adjacent end of the slide bar, and a latch pin carried on the slide bar and movable into said latch recess as an incident of movement of the slide bar to said thrown position.

12. For use in a housing structure having a cabinet having an access opening defining opposite sides, and a door for selectively closing said opening, hinge means for mounting the door to the cabinet permitting the door to be opened from either side of the opening, said hinge means comprising:

a pair of pivot pins on the door one each at opposite sides of the door;

means defining pivot recesses on the cabinet one each at said opposite sides of the opening for removably receiving said pivot pins;

a slide bar selectively reciprocably movable on the cabinet and having opposite ends defining catches for releasably retaining the pivot pins, said catches and slide bar being constructed to prevent concurrent movement of both pivot pins outwardly from said pivot recesses; and means responsive to opening movement of the door from either side effecting withdrawal of the pivot pin thereat from its associated recess for effectively locking the slide bar in a thrown position preventing withdrawal of the other pivot pin from its associated recess, said means comprising deflectible stop means at each end of said slide bar disposed to extend rigidly between said cabinet and said slide bar as an incident of the slide bar being moved to said thrown position, each said stop means comprising a close coiled spring having one end secured to one of said cabinet and slide bar and an opposite end removably engaged with a stop shoulder fixed to the other of said cabinet and slide bar, said spring being disposed to be transversely deflected from engagement with said stop by the hinge pin as an incident of said hinge pins being engaged with said catches.

13. The hinge means of claim 12 wherein said one end of said spring secured to one end of said slide bar.

* * * * *